US006007147A

United States Patent [19]

McCracken

[11] Patent Number: 6,007,147

[45] Date of Patent: Dec. 28, 1999

[54] QUICK-STOW PICNIC TABLE SUPPORTS

[76] Inventor: Michael Ray McCracken, 36001 Clear Pond Rd., Shawnee, Okla. 74801

[21] Appl. No.: 09/167,975

[22] Filed: Oct. 8, 1998

[51] Int. Cl.[6] ..... A47B 39/00

[52] U.S. Cl. ..... 297/158.5; 297/158.3; 297/440.14

[58] Field of Search ..... 297/159.1, 157.1, 297/158.3, 158.5, 440.1, 440.14; 108/64, 101, 180, 181, 185, 186, 135, 154, 157.1, 157.17, 158.12, 158.13

[56] References Cited

U.S. PATENT DOCUMENTS

| | | | |
|---|---|---|---|
| 2,848,119 | 8/1958 | Fitser | 108/101 |
| 4,060,275 | 11/1977 | Hansen | 297/159 |
| 4,572,574 | 2/1986 | Fischhaber et al. | 297/159 |
| 4,607,880 | 8/1986 | Gastebled | 297/158.5 |
| 4,648,652 | 3/1987 | Van Kuren | 297/159 |
| 4,700,986 | 10/1987 | Davis et al. | 297/157 |
| 5,224,753 | 7/1993 | Fox | 297/158.5 |
| 5,791,265 | 8/1998 | Ellsworth et al. | 108/180 |

*Primary Examiner*—Laurie K. Cranmer
*Attorney, Agent, or Firm*—Patent & Trademark Services; Thomas Zack; Joseph H. McGlynn

[57] ABSTRACT

Two substantially identical spaced rigid brace supports used to slidable receive boards to form a picnic table's top with lower side bench seats. Each brace support frame is identical and has two side frame legs, a top frame and a lower ground engaging bottom frame member. Extending outwardly from about the mid-portions of each frame leg are two closed loop members used to slidably receive board members used to form bench seats. Partitioned spaces formed between the top frame member of the brace support and a parallel lower frame member act to receive additional board members that are used to form the table's top surface. The weight of the two facing rigid brace supports coupled with their inwardly top slanted orientation causes the engaged rigid brace support frame members forming the openings to bear against and frictionally hold the inserted board members to the two spaced brace supports.

4 Claims, 1 Drawing Sheet

QUICK-STOW PICNIC TABLE SUPPORTS

BACKGROUND OF THE INVENTION

Outdoor tables such as picnic tables provide a very delightful place for meals, gatherings and other activities. However, since they are usually relatively large and heavy they are not readily movable into and out of storage. The result is that many are left outside all or most of the year resulting in excessive weather damage to them. One solution has been to provide for a collapsible picnic table that can be folded and stored when not in use outdoors.

Generally such collapsible tables have proven useful for their intended purpose. The present invention relates to brace supports used to receive boards to form a table that can be used indoors or outdoors in which several separate boards are easily fitted into two spaced supports to provide for an upper table top and lower side seat benches all as will be described in detail hereafter.

DESCRIPTION OF THE PRIOR ART

Tables or planar structures that can be folded or taken apart for transport or storage are known. For example, in the Hansen invention (U.S. Pat. No. 4,060,275) a collapsible table is disclosed having hinged legs, a hinged support for legs and integral benches.

The Fischhaber et al. patent (U.S. Pat. No. 4,572,574) discloses a collapsible table structure with interconnected bench seats having cross braces thereunder having sideways.

In U.S. Pat. No. 4,648,652 to Van Kuren the a collapsible picnic table is described having pivotally connected legs to the table top with transverse bars connected to the legs used to support the seats.

In the Davis et al. reference (U.S. Pat. No. 4,700,986) a collapsible portable totetable using a novel dog system to interconnect the various parts.

The present invention relates to two spaced brace supports adapted to receive boards to form a table top and two side benches all as more fully set forth in this specification.

SUMMARY OF THE INVENTION

This invention relates to two substantially identical spaced rigid brace supports used to holding members that slidably receive boards to form a picnic table's top and lower side benches.

It is the primary object of the present invention to provide for improved brace supports that can receive boards that are used to form a table top and two side benches.

Another object is to provide for such supports that are substantially identical and spaced from each other and oriented with respect to each other such that their top frame members are closer together than their bottom frame members when assembled with boards.

These and other objects and advantages of the present invention will become apparent to readers from a consideration of the ensuing description and the accompanying drawings.

DESCRIPTION OF THE PREFERRED EMBODIMENT

Figure 1:
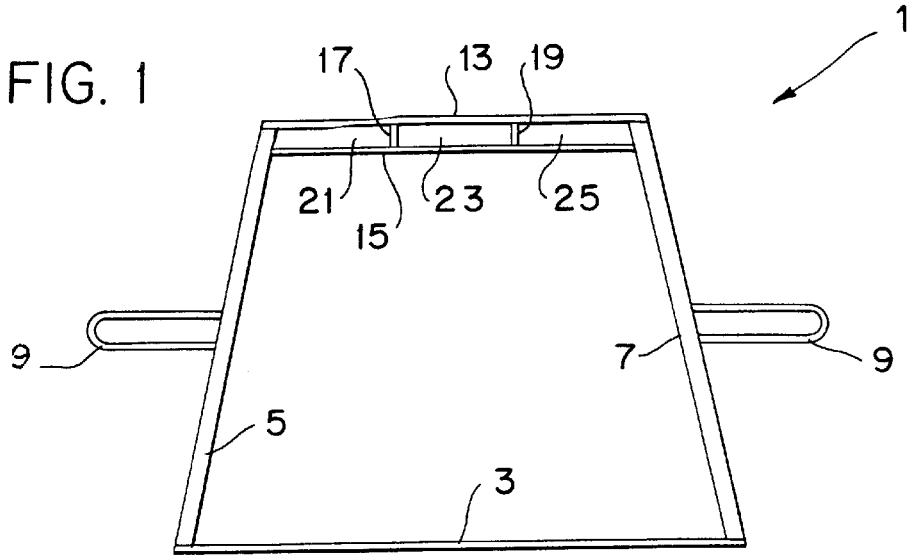
FIG. 1 is a end view of one of the invention's two brace supports used in the preferred embodiment.

FIG. 1 is a end view of one of the invention's two identical brace supports 1 used in the preferred embodiment. The rigid metallic frame brace support 1 is made up of several major rigidly interconnected frame connected components whose outside is generally trapezoidal in shaped, as shown in this view. The bottom ground engaging lowest frame member 3 interconnects and spans the distance between the two inwardly slanting vertically disposed identical side frame legs 5 and 7. Each of these metal legs has a rigid closed outwardly extending metal closed loop member 9 or 11 attached to the leg just above the midpoint length of each leg. The longest outwardly extending dimension of each of the two loop closed members extends generally horizontally and is used to receive within their formed openings separate boards that are used as side bench seats for the table.

At the upper portion of the brace support 1 there is are two spaced, straight and parallel horizontally disposed frame members 13 and 15. Members 13 and 15 span the distance between the tops of the slanted legs 5 and 7 and are rigidly fixed to the legs at their respective ends. Between the parallel top frame members 13 and 15 are two vertical smaller spaced frame support members 17 and 19 that act as partition members to form opened spaces between them. Each of the two vertical support members are rigidly attached at their ends to the members 13 and 15.

The three open spaces 21,23 and 25 formed by the interconnected frame members 13,15,17 and 19 are such that one conventional board, like a conventional wooden 2 by 10 inch board in cross section, may be slide end first into each of these formed three spaces in a relatively snug fit. The top surfaces of such of the inserted boards forms the table top surface.

As stated before, there are two such identical brace supports, like the brace 1 shown in FIG. 1, used to form the table's complete support frame which along with the inserted five boards constitutes the table top and the two side benches.

Figure 2:
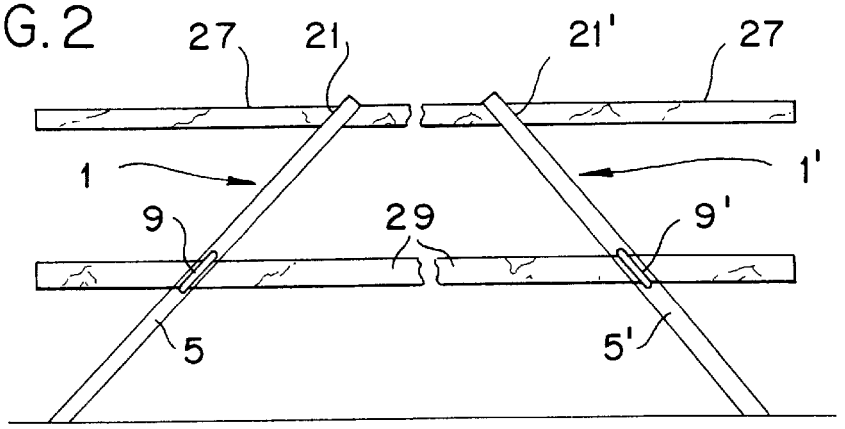
FIG. 2 is a side view showing two of the FIG. 1 brace supports facing each other and interconnected by boards.

FIG. 2 is a side view showing two identical FIG. 1 brace supports 1 and 1' facing each other and interconnected by wooden boards. In this embodiment, the wooden boards are conventional 2 by 10 boards that span the distance between the inwardly top slanted spaced brace supports. Three horizontally disposed parallel boards 27 (only the near one of which is shown) form the upper table top surface. Each board was slidably received in one of the three frame upper spaces 21,23 and 25, respectively, shown in FIG. 1 in each of the two spaced brace supports 1 and 1'.

The lower side bench seat boards 29 (only the near one of which is shown) are also slidably received in the two side spaced loop closed members 9 and 9' to form a bench seat. One such horizontally disposed side board 29 interconnects the two identical brace supports 1 and 1' through their aligned side loop members 9 and 9'. In like manner there is another opposite side bench seat board 29 directly behind the shown front board 29 which extends through the two other other side aligned loop members 11 and 11' (not shown in this view) located on the far side of the brace supports 1 and 1' above the lower ground G. Both formed side benches are about the same height above the ground.

Figure 3:
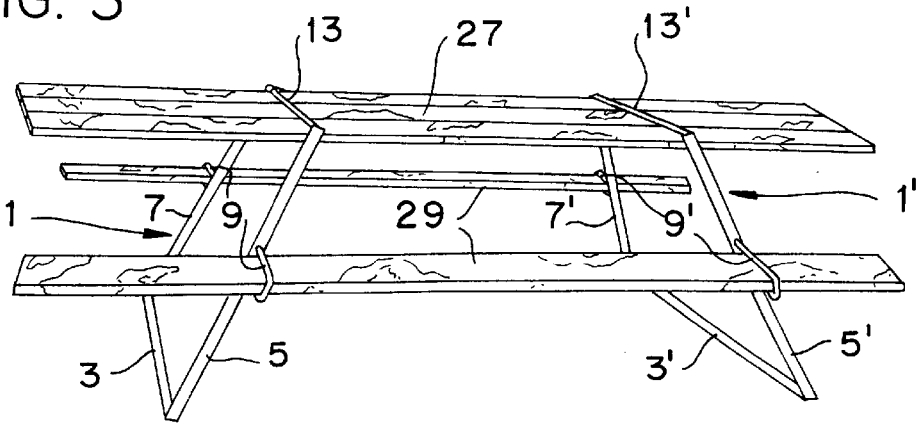
FIG. 3 is a side perspective view showing two spaced brace supports inte connected by boards to form a table top and two side benches.

FIG. 3 is a side perspective view showing the two identical spaced brace supports 1 and 1' interconnected by the three upper spanning top (27) and two lower side bench boards (29) to form an upper table top surface and two lower side benches, respectively. As seen in this view, the rigid brace supports 1 and 1' slant towards each other such that their upper frame members 13 and 13' are closer together than their lower ground engaging members 3 and 3'.

Due to the vertical spacing of the rigid formed six metal upper spaces (21,21, 23,23' and 25,25') and the four side leg loops (9, 9',11 and 11') the slanted engaged brace supports bear against the horizontal surfaces of the enclosed boards to form a very rigid structure that is self supporting. No bolts, nails, fasteners, glues, bonding materials or the like need be used to hold the boards to the brace support members.

To disassemble the rigid self supporting table shown in FIG. 3, the top boards 27 are lifted to vertically raise each of the inwardly slanted brace supports 1 and 1'. When this happens the boards no longer bear against the formed boarding receiving frame members and the two side loops allowing the boards to be slidably withdrawn from these frame spaces for storage. Thus, when in a disassembled state the five boards and the two brace supports can be easily stored for future use in a protected area like a garage or basement.

The number of formed upper board receiving spaces and their individual dimensions of the formed frame spaces can vary as desired depending on the cross section of the boards and the number of boards to be used. Clearly, prefabricated plank or board like members, e.g., elongated plastic or metal rectangular plank members, other than the shown wooden boards or planks. could be manufactured and used with the two rigid spaced brace supports to form a table with side bench seats all without the need for fasteners, bonding materials, etc. to hold the planks to the brace support members. The selection of specific materials for the brace supports and inserted plank members depends on the ability of the interfacing members to achieve the desired results. Thus, the interfacing bearing surfaces between the frame members and the inserted planks must have sufficient frictional values to prevent the sliding of one relative to the other when assembled as shown for example in FIG. 3.

In one specific embodiment each of the brace supports 1 and 1' has the following dimensions: legs 5 and 7 total length of 35 inches; lower ground engaging members 3 and 3' a total length of 46 inches; the length of the upper frame members 13 and 13' was 31.25 inches with the three spaces formed between the members 15 and 15' each being 2 inches in height by 9.5 inches wide; and the four side loops 9/9' and 11/11' were each 2 inches in vertical height by 9.25 outward to receive a 2 by 10 conventional wooden board.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A brace support system used to form a table comprising:

a first rigid brace support member having two interconnected side leg members of substantially the same length, a top horizontally disposed member joined to said legs members at their upper ends and a bottom horizontally disposed member joined to the lower ends of said legs members, said first brace support member having two outwardly extending bench seat receiving shaped members fixed to each of the side leg members;

said top member having a lower spaced generally parallel member connected to each of the side legs with a plurality of partitions fixed between the top member and the lower spaced member to form a plurality of opened spaces each of which spaces is adapted to receive an inserted table top forming member;

a second rigid brace support member spaced from said first brace support member and substantially identical in construction thereto, said second rigid brace support member having two side leg members with substantially the same lengths, a top horizontally disposed member with a plurality of partitions joined to the upper portion of each of said leg members and a bottom horizontally disposed member joined to the lower portions of each of said leg members, said second brace support member having outwardly extending bench seat receiving shaped members fixed to each of the side leg members and adapted to be horizontally aligned with said bench seat receiving members of said first brace support member to receive bench seat plank members;

said bench seat receiving shaped members on said first brace support member and said second brace support member each being formed by closed cantilevered loops having opened spaces, said opened spaces being adapted to slidably receive within their opened spaces elongated bench seat members when said loops are horizontally aligned with each other; and a plurality of elongated separate table top forming members equal in number to the number of partitions formed in each of the top members of said first and second rigid brace support members, each of said elongated separate members being adapted to be inserted into one of the formed partitions between the top member and the lower spaced member of said first brace support member and said second brace support member to span the distance between the first and second brace supports member and to form a top table surface interconnecting the two brace support members.

2. The brace support system as claimed in claim 1, also including elongated bench seat plank members that can slidably be received in said closed side loop members of the first brace support and the second brace support when horizontally aligned with each other.

3. The brace support system as claimed in claim 2, wherein the two side legs and the top and the bottom members of both the first brace support member and the second brace support member are each individually joined together to form a trapezoid shaped frame structure.

4. The brace support system as claimed in claim 2, wherein said two outwardly extending bench seat receiving shaped members fixed to each of the side leg members for said first brace support are fixed at approximately the middle of the brace's legs.

* * * * *